US009371834B2

(12) United States Patent
Daugaard

(10) Patent No.: US 9,371,834 B2
(45) Date of Patent: Jun. 21, 2016

(54) CENTRIFUGAL PUMP

(75) Inventor: Poul Anton Daugaard, Kolding (DK)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 13/642,984

(22) PCT Filed: May 3, 2011

(86) PCT No.: PCT/SE2011/050553

§ 371 (c)(1),
(2), (4) Date: Oct. 23, 2012

(87) PCT Pub. No.: WO2011/139223

PCT Pub. Date: Nov. 10, 2011

(65) Prior Publication Data

US 2013/0039745 A1 Feb. 14, 2013

(30) Foreign Application Priority Data

May 3, 2010 (DK) ..... 2010 70183

(51) Int. Cl.
*F04D 7/04* (2006.01)
*F04D 29/22* (2006.01)

(52) U.S. Cl.
CPC ..... *F04D 7/045* (2013.01); *F04D 29/2288* (2013.01)

(58) Field of Classification Search
CPC ..... F04D 1/00; F04D 17/08; F04D 29/22; F04D 29/2216; F04D 29/2288; F04D 29/42; F04D 29/4206; F04D 29/4213; F04D 29/701; F04D 7/045
USPC ..... 415/121.1, 121.3; 416/182, 185, 179
See application file for complete search history.

(56) References Cited

U.S. PATENT DOCUMENTS 2,272,573 A * 2/1942 Messmore ..... 366/263
2,890,660 A * 6/1959 Umbricht ..... 415/121.1
3,128,051 A * 4/1964 Smith ..... 415/121.1

(Continued)

FOREIGN PATENT DOCUMENTS

CN 2601315 Y 1/2004
DE 100 03 396 A1 8/2001

(Continued)

OTHER PUBLICATIONS

International Search Report (PCT/ISA/210) issued on Jul. 20, 2011, by the Swedish Patent Office as the International Searching Authority for International Application No. PCT/SE2011/050553.

(Continued)

*Primary Examiner* — Richard Edgar
(74) *Attorney, Agent, or Firm* — Buchanan Ingersoll & Rooney PC

(57) ABSTRACT

A centrifugal pump that includes a casing in which an impeller is arranged. The impeller has a back side that faces a back plate of the centrifugal pump, and one or more vanes for pumping the fluid. The back side of the impeller includes a segmented scraper for scraping from the back plate material that has been deposited from the fluid. The segmented scraper includes multiple protrusions, wherein each protrusion of the multiple protrusions is facing the back plate, and an aggregated radial extension of the protrusions equals a radius of the impeller within an interval of ±10%, ±25% or even up to ±40%.

17 Claims, 3 Drawing Sheets

(56) References Cited

U.S. PATENT DOCUMENTS

| | | | | | |
|---|---|---|---|---|---|
| 3,384,026 | A | * | 5/1968 | Williamson, Jr. | 415/143 |
| 3,603,563 | A | * | 9/1971 | Holland | 366/317 |
| 3,663,117 | A | * | 5/1972 | Warren | 415/116 |
| 4,176,972 | A | | 12/1979 | Stiling | |
| 4,921,400 | A | * | 5/1990 | Niskanen | 415/169.1 |
| 5,586,729 | A | * | 12/1996 | Davenport | 241/21 |
| 7,118,327 | B2 | * | 10/2006 | Doering et al. | 415/121.1 |
| 7,465,153 | B2 | * | 12/2008 | Addie et al. | 415/172.1 |
| 7,584,916 | B2 | | 9/2009 | Shaw | |
| 2005/0053461 | A1 | | 3/2005 | Doering et al. | |

FOREIGN PATENT DOCUMENTS

| | | | | |
|---|---|---|---|---|
| GB | 1 388 889 | A | | 3/1975 |
| GB | 2 124 095 | A | | 2/1984 |
| JP | S56-066494 | A | | 6/1981 |
| JP | H06-033798 | B2 | | 5/1994 |
| NL | 275 238 | A | | 10/1964 |
| WO | WO 2005002732 | A1 | * | 1/2005 |

OTHER PUBLICATIONS

International Preliminary Report on Patentability (PCT/IPEA/409) issued on Aug. 29, 2012, by the Swedish Patent Office as the International Searching Authority for International Application No. PCT/SE2011/050553.

Chinese Office Action issued Sep. 30, 2014, by the Chinese Patent Office, in corresponding Chinese Patent Application No. 201180022348, and English language translation of Chinese Office Action (21 pages).

* cited by examiner

CENTRIFUGAL PUMP

TECHNICAL FIELD

The invention relates to a centrifugal pump for pumping a fluid. The centrifugal pump comprises a casing in which an impeller is arranged. The impeller has a back side that faces a back plate of the casing and a gap is formed between the back side of the impeller and the back plate of the casing. The impeller has one or more vanes for pumping the fluid, and a connector extends from the impeller and through said back plate of the centrifugal pump, for connection of the impeller to a drive mechanism for rotating the impeller. The invention also relates to an impeller.

BACKGROUND

In the industry it is common to use pumps for pumping a fluid in a process plant such as a centrifugal pump used in an evaporator application. Such a pump typically has a casing in which an impeller is fitted. The impeller has a back side facing a back plate in the casing and a number of vanes on the front side in order to pump the fluid. Between the back side of the impeller and the back plate of the casing there is typically a gap. E.g. in evaporator applications where a fluid is heated and thus water is evaporated, a dry matter content of the fluid can become high. When a hot fluid with a high content of dry matter is processed a build up of the dry matter may occur in the casing. Especially in the mentioned gap between the casing and the impeller, the dry matter in the fluid tends to build up and deposit as a hard layer. This deposited dry matter creates an increased friction in the pump and thus a significant need for energy to power the pump. This energy is typically supplied from an electric motor. If the energy consumption becomes too high the motor will overheat and shut down. As a consequence a complete production system may shut down, and cleaning of the pump or of the complete system may have to take place before running the system again. Also, when the deposits are building up the efficiency of the pump is gradually reduced.

In e.g. a dairy plant it is common to have the plant working in two shifts, each of eight hours and performing cleaning in the third eight-hour shift, and in this way working round the clock. However, it is difficult to obtain efficient shift work as the pumps on the market tend to seize in deposits in shorter time.

To overcome the above mentioned problems it is known to have means for scraping between a back side of an impeller in a pump and a back plate of the pump. Such means have the form of scraper bars on back-sides of vanes on the impeller. The scraper bars per se are shaped as a kind of vanes on the back side of the impeller, and one vane-shaped scraper bar is arranged on each of the vanes. E.g. an impeller with six vanes would then have six scraper bars, one on each vane, which will have no influence on the balance of the impeller as all vanes and scraper bars have identical shape and are symmetrically arranged on the impeller. One such example is known from NL 275238, which document discloses one scraper bar on each vane. The scraper bars decrease building up of dry matter and thereby prolong an operational time of the pump, but in most cases the dry matter will still deposit faster than acceptable and thus lower a production time and capacity normally offered by the pump, while simultaneously increasing the energy consumption.

SUMMARY

An object of the invention is to provide a centrifugal pump for pumping a fluid with a relatively high content of dry matter, where an impeller is used and where a gap between said impeller and the back plate is present, and where an acceptable friction between the impeller and the back plate is maintained for a longer time in comparison with the known impellers. Additionally or alternatively, energy required for driving the pump is reduced. The centrifugal pump has an impeller with means for scraping deposited material from said fluid of the back plate. The centrifugal pump is characterised in that the back side of the impeller is fitted with segmented scraper means comprising multiple protrusions, where each protrusion is facing a back plate of the centrifugal pump and constitutes a scraper unit, where an added radial extension of said protrusions equals a radius of the impeller within the interval of ±10%, ±25% or even up to ±40%.

In this context +10, +25 or +40% indicates that the added (aggregated) radial extension of the scraper means is 10, 25 or 40% longer than the radius of the impeller. Thus, there may be an overlap between at least some of the individual scraper means.

In the same sense −10, −25 or −40% indicates that the added radial extension of the scraper means is 10, 25 or 40% shorter than the radius of the impeller. Thus, there may be a gap between at least some of the individual scraper means. Such a gap or overlap can be present in a uniform manner where all the scraper means are arranged with equal gap or overlap, but it is also possible to have the scraper means arranged on an impeller, where there are gaps as well as overlaps with different size between the specific scraper means. The "radial extension" refers per se to an extension in a radial direction of the impeller, where the radial centre is a centre of the impeller.

In this way the area of the back plate, located behind the impeller, is kept free from deposits as each of the protrusions are covering and scraping a ring shaped area as the specific protrusion is describing a circle when the impeller is rotating. The added length of the segmented scraper can in one embodiment be within the interval of ±10% of the radius of the impeller and thus cover a significant area of the back plate and preventing or at least postpone the build up of dry matter in the gap. This is advantageous in that the area of the multiple scraper units or protrusions more or less functionally equals one prior art scraper bar, where prior solutions have had a scraper bar on each of the vanes—typically five vanes and also five scraper bars. This gives a reduction in the friction area to about ⅕. One further advantage is that the segmented scraper protrusions are creating more turbulence in the fluid in the gap. Having this increased turbulence in the fluid reduces build up of the dry matter and in this way the gap is held more free from deposits. Further, less energy is consumed due to fewer deposits in the gap and due to less friction area of the scraper. This also means that a longer time interval between cleaning stops is obtained, resulting in a more efficient use of the production facilities.

The added length of the segmented scraper protrusions can in some embodiments be within the interval of ±25% or even within the interval of up to ±40% of the radius of the impeller. The coverage of the radius by the protrusions can be chosen for a specific fluid or for a specific position in a process plant according to experience or empirical studies. It is often desirable to obtain sufficient turbulence and also sufficient coverage of the area to keep free from deposits. For some fluids or conditions small area coverage is needed and for other fluids or conditions a larger coverage is needed. With a centrifugal pump with the disclosed impeller, it is possible to have the impeller fitted with a number and size of protrusions that will fit various demands.

Tests with a centrifugal pump with different impellers and in a specific plant has shown that with full length scrapers on the back side of each vane, it is possible to lengthen the time from 5-6 hours to 8-9 hours between cleaning when comparing to an impeller with no scrapers. Further tests has shown that, compared to full length scrapers, a centrifugal pump with an impeller as described herein can be expected to run for about 20 hours compared to 8-9 hours. This is advantageous as the production time can be increased and the unproductive time during cleaning can be minimized.

In a centrifugal pump as disclosed said multiple protrusions are arranged with a distance to each other, and at a various radius on the back side of the impeller. In this way the complete area is covered, the fluid is turbulent and the dry matter will only build up over a longer time interval giving more working hours between cleaning.

In several embodiments of the centrifugal pump at least one of said multiple protrusions can be arranged with a convex surface, and/or with a concave surface, and/or with a right angled surface, and/or with a tilted surface in the rotating direction of the impeller. Depending on the application where the centrifugal pump with the impeller is used, different shapes of the protrusions can be chosen. Also protrusions on a specific impeller can be made with different shapes and contour, depending on the specific radius, at which it is located, as the flow in the gap can be different at the centre of the impeller compared to the flow near or at the periphery of the impeller. Thus different shapes of the protrusion can be used to secure the wanted turbulence and also an effective scraping.

In another embodiment of the centrifugal pump, at least two of the said multiple protrusions can be arranged with an angular distance on the back side of the impeller. The protrusions can be arranged with an angular distance that will match the angular distance of the vanes on said impeller.

Further, the centrifugal pump can be arranged with at least two of the said multiple protrusions arranged at a different radius on said impeller.

By having the protrusions more or less evenly distributed over the back side of the impeller, it becomes easy to maintain the balance in the impeller. This can be made even easier by using relatively small protrusions seen in the radius direction, as the weight of each protrusion becomes very small and thus has a minor impact on the balance. With protrusions disclosed herein it is possible to adjust the size, shape and location of each single protrusion according to specific demands and applications. Such a centrifugal pump will, as mentioned above, have a less power consumption and longer intervals between cleaning and thus also an attractive sturdiness. Other objects as well as features, aspects and advantages of the invention will appear from the following, summary and detailed description, from the attached claims as well as from the drawings.

BRIEF DESCRIPTION OF THE DRAWINGS

Embodiments of the invention will now be described, by way of example, with reference to the accompanying schematic drawings, where.

DETAILED DESCRIPTION

Figure 1:
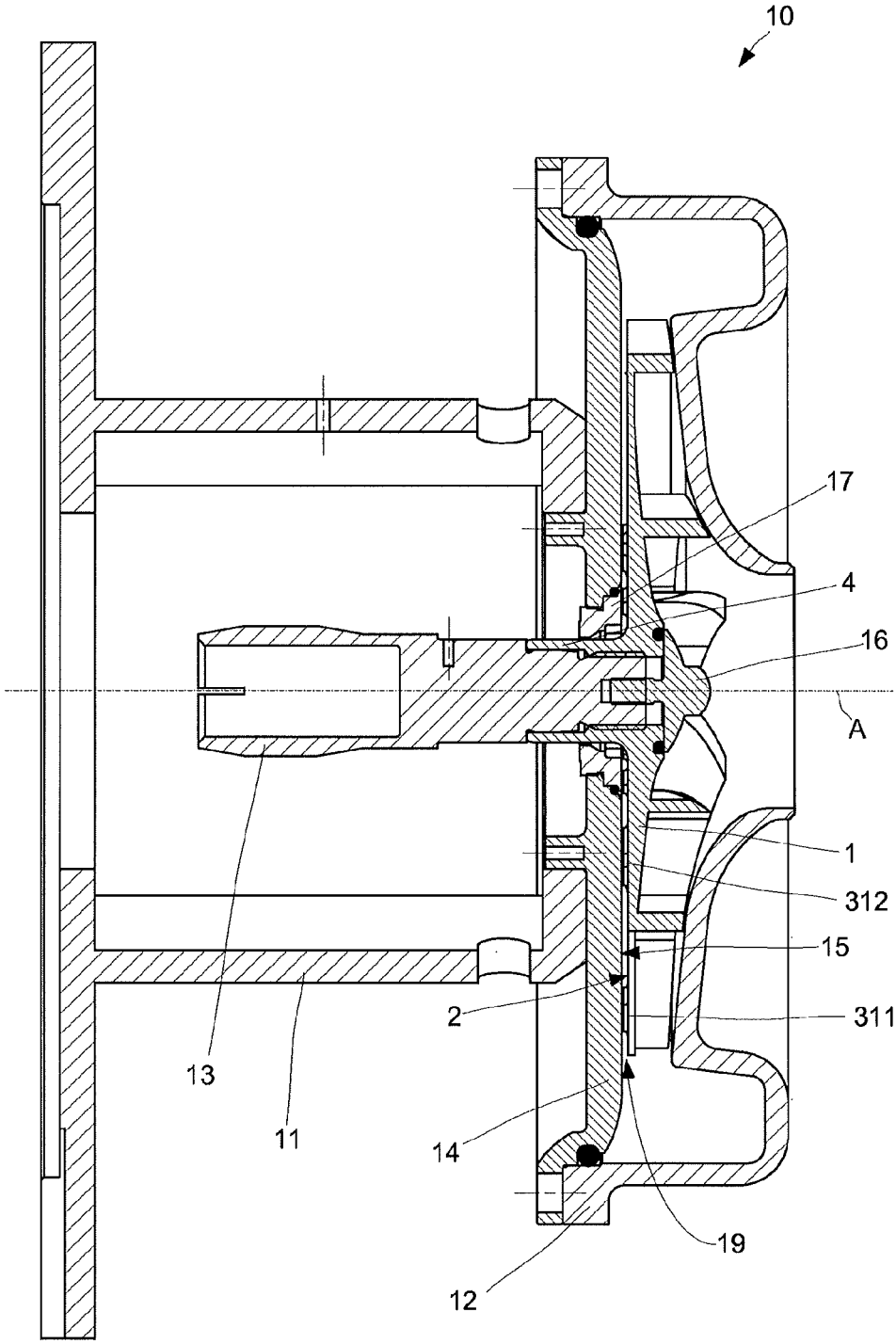
FIG. 1 is a cross-sectional view of a centrifugal pump with an impeller, on which scraper protrusions are arranged.

With reference to FIG. 1 a centrifugal pump 10 is illustrated. The centrifugal pump 10 comprises a casing, or pump house, in form of a first pump house part 11 and a second pump house part 12. The pump house parts 11, 12 are connected to each other via a plate 14, which is also referred to as a back plate 14. The back plate 14 may be seen as a part of the casing, by virtue of connecting the pump house parts 11, 12 to each other. The casing 11, 12 and the back plate 14 have substantially symmetrical shapes about a centre axis A of the centrifugal pump 10. An impeller 1 is positioned within the centrifugal pump 10, in between the second pump house part 12 and the hack plate 14. The impeller 1 is capable of feeding a fluid through the centrifugal pump 10 when it is rotated. For accomplishing rotation of the impeller 1 it has a hub 4 (connector) that is centred on the centre axis A, supported by a bearing 17, and attached to a drive axle 13 via treads on the impeller 1 and on the drive axle 13. To secure the impeller 1 to the drive axle 13 an end cap 16 is screwed into an end of the drive axle 13 where the impeller 1 is attached. The drive axle 13 may be referred to as a drive mechanism, and is typically connected to an electrical motor for transferring a torque to the drive axle 13, such that the impeller 1 is rotated and fluid is pumped through the centrifugal pump 10.

The impeller 1 is arranged with a side 2 facing a surface 15 of the centrifugal pump 10. The side 2 of the impeller 1 that faces the surface 15 is also referred to as a back side 2 of the impeller 1, and the surface 15 of the centrifugal pump 10 is typically a surface of the back plate 14. Both the impeller side 2 and surface 15 of the back plate 14, which surface 15 is faced by the impeller side 2, may have essentially flat, parallel surfaces. Thus, the impeller 1 has a back side 2 that faces the back plate 14.

The impeller 1 is arranged with the back side 2 at a distance from the surface 15 of the back plate 14, such that a gap 19 is formed between the back side 2 and the back plate 14, at the back side 2 of the impeller 1. When fluid is pumped through the centrifugal pump 10, material from the fluid may deposit on the surface 15 of the back plate 14, as discussed above. For scarping deposits off from the surface 15 the impeller 1 has a segmented scraper that comprises a number of (multiple) protrusions, such as protrusions 311 and 312. The segmented scraper is further described below.

Figure 2:
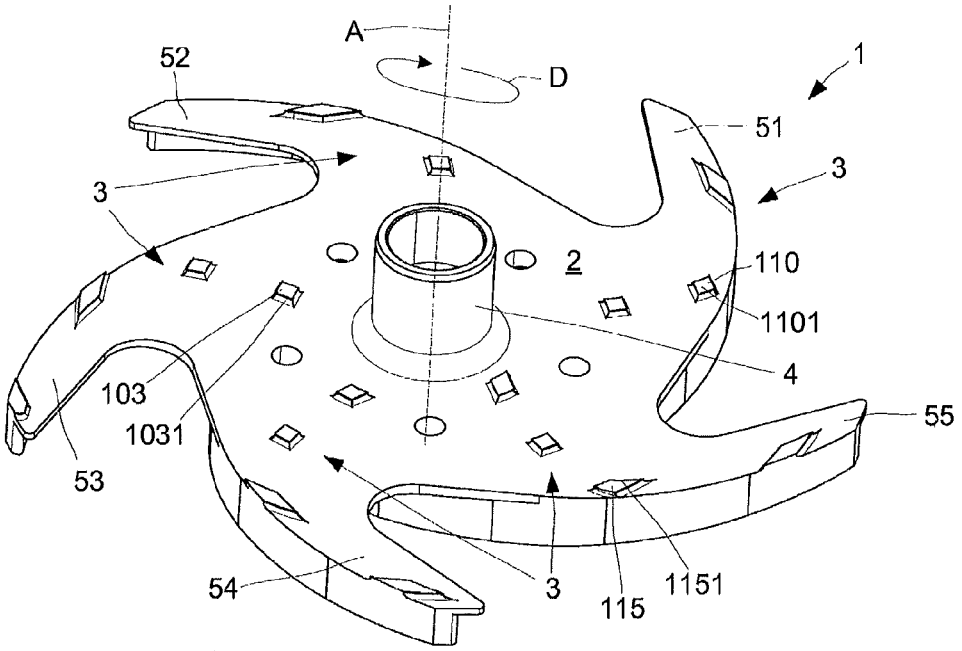
FIG. 2 is a perspective view of the impeller of FIG. 1.

With reference to FIG. 2 the impeller 1 for the centrifugal pump 10 is shown. As indicated, the impeller 1 has a back side 2, with a number of scraper protrusions 3. At the centre of the impeller 1, the hub 4 for connecting the impeller 1 to the drive mechanism 13 is shown. On this embodiment of the impeller 1 there are five vanes 51-55 that protrude from the impeller 1. When the impeller 1 is fitted into the casing 11, 12 of the centrifugal pump 10, the scraper protrusions 3 are located with a distance of approximately 0.5 to 3 millimeters from the back plate 14 of the casing 11, 12. As may be seen from FIG. 1, the protrusions 3 are arranged at a distance from each other. It may be said that the impeller has a "front side" fitted with the vanes 51-55.

Figure 3:
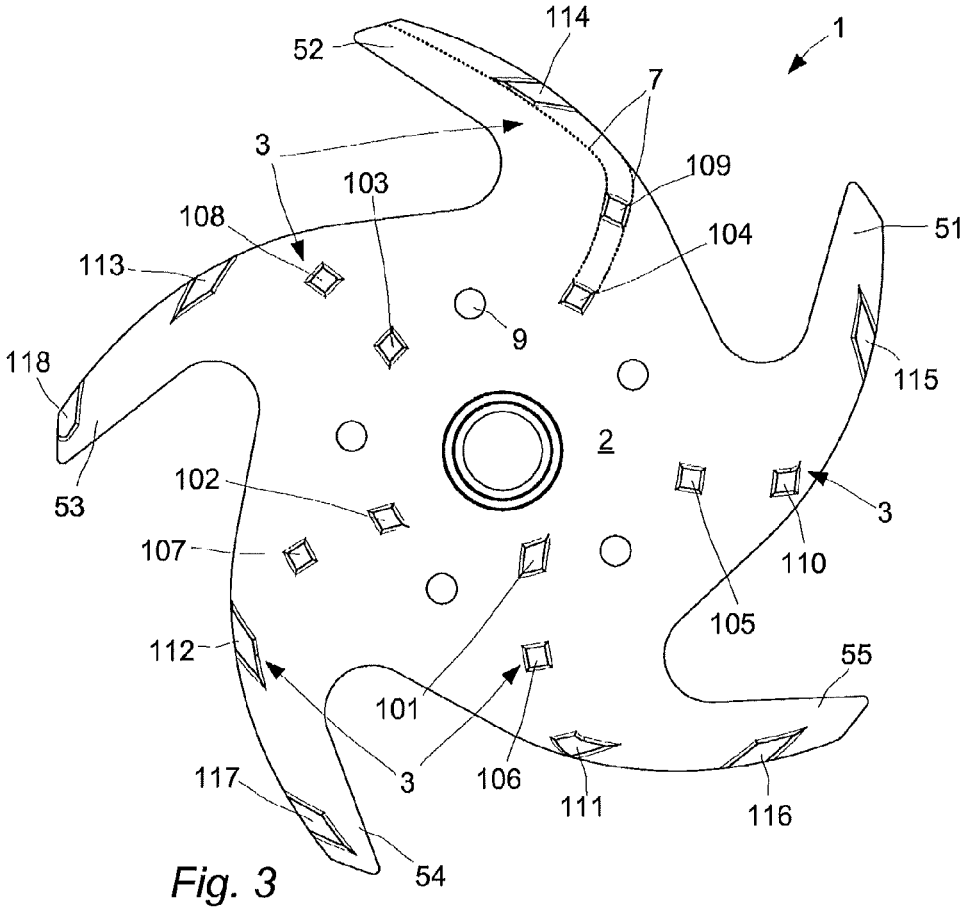
FIG. 3 is a back-side view of the impeller of FIG. 1.

With reference to FIG. 3 the impeller 1 is illustrated from the back side 2. The vanes 51 -55 are shown and also the hub 4 is shown. Adding the length of all the protrusions 3 and at the same time placing all the protrusions 3 in "functional contact" with each other, they will create what functionally resembles a scraper bar, having more or less the shape of a vane as shown with the dotted line 7. A number of holes extend through the impeller 1, such as hole 9, and are employed for obtaining a proper balance of the impeller 1 and/or for obtaining a desirable pressure distribution over the impeller 1 when it is rotating.

Figure 4:
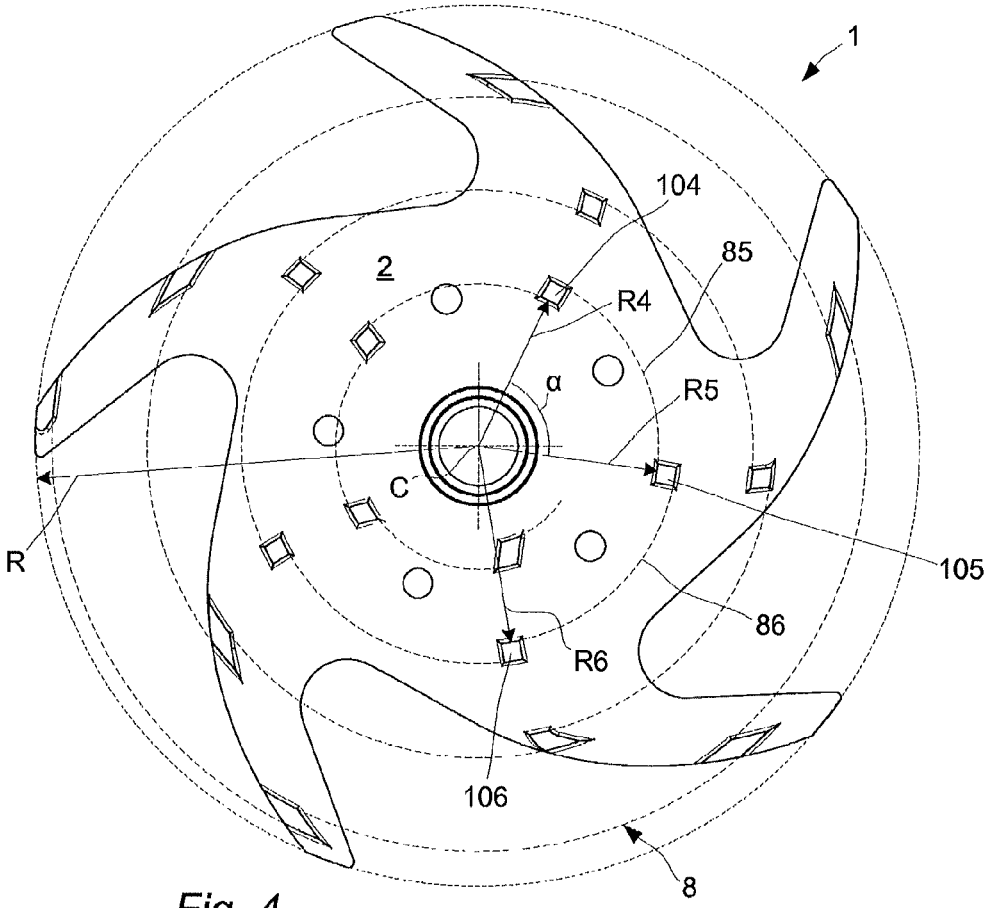
FIG. 4 is a view that corresponds to FIG. 3, where support lines are drawn for illustrating the arrangement of the scraper protrusions.

With reference to FIG. 4, the pattern of the segmented scraper protrusions 3 is shown, with dotted lines 8, drawn as a spiral, showing that the protrusions 3 all together create what functionally resembles one full scraper bar. In the known solutions a full length scraper bar is arranged on each vane. By this solution accomplished by the scraper protrusions only ⅕ of the friction area is present, in comparison with known solutions, and thus less friction will occur and less energy will be consumed.

It is of course possible to have a gap or an overlap between the individual protrusions, but in this example the individual protrusions 3 has no gap and no overlap.

In detail, with reference to FIGS. 2-4, in the exemplified embodiment the segmented scraper 3 comprises eighteen protrusions 101-118 that are distributed over the surface 2 of the impeller 1. The multiple protrusions 101-118 are arranged on the impeller 1 in a spiral-shaped pattern 8, as can be clearly seen in FIG. 4 where two sections 85, 86 of the spiral-shaped pattern 8 are indicated by reference numerals. The multiple protrusions 101-118 are arranged at various radial distances from a centre C of the impeller 1. For example, protrusion 104 is arranged at radial distance R4, protrusion 105 is arranged at radial distance R5 and protrusion 106 is arranged at radial distance R6 from the centre C. The scraper 3 may by virtue of its protrusions 101-118 scrape deposited material off from the surface 15 of the centrifugal pump 10. The multiple protrusions 101-118 of the scraper 3 have an aggregated radial extension that equals a radius R of the impeller 1 within an interval of ±10%, ±25% or even up to ±40%.

The aggregated extension of the multiple protrusions 101-118 is the sum of their extension in the radial direction. In the illustrated example, the aggregated radial extension of protrusions 104-106 is calculated as (R6−R5)+(R5−R4)=R6−R4. The total aggregated radial extension of all protrusions may be calculated in a similar manner, and the calculated value, i.e. the total radial extension of all protrusions 101-118, should be within the interval of ±10%, ±25% or even up to ±40% of the radius R or the impeller 1.

The protrusions 101-118 are arranged at various angular distances from each other, as seen from a centre C of the impeller 1. For example, protrusion 105 is arranged at an angular distance a from protrusion 104. A number of or even all of the multiple protrusions 101-118 may comprise, as seen in a rotational direction D of the impeller 1, any of a convex surface, a concave surface, a right angled surface and a tilted surface. For example, turning back to FIG. 2, protrusion 115 may have a convex surface 1151, protrusion 110 may have surface 1101 that is right angled, and protrusion 103 may have a surface 1031 that is slanted in relation to the rotational direction D.

The invention is not limited to the embodiments described above and shown on the drawings, but can be supplemented and modified in any manner within the scope of the invention as defined by the enclosed claims. For example, the impeller may have another number of vanes, another number of scraper protrusions, the scraper protrusions may be arranged in a different pattern etc.

The invention claimed is:

1. A centrifugal pump for pumping a fluid, the centrifugal pump comprising:

a casing in which an impeller is arranged, the impeller having a back side facing a back plate of the centrifugal pump, wherein a gap is formed between the back side and the back plate, the impeller having one or more vanes for pumping the fluid;

a connector extending from the impeller and through the back plate of the centrifugal pump, for connection of the impeller to a drive mechanism for rotating the impeller;

the back side of the impeller comprising a segmented scraper for scraping from the back plate material that has deposited from the fluid, the segmented scraper comprising multiple protrusions on the back side of the impeller;

at least some of the multiple protrusions being arranged at different radial distances from a centre of the impeller;

each of the multiple protrusions faces the back plate; and an aggregated radial extension of all of the protrusions equals a radius of the impeller within an interval of up to ±25%, the aggregated radial extension of the protrusions being a sum of the extension of all of the protrusions in the radial direction.

2. A centrifugal pump according to claim 1, wherein at least one of the protrusions comprises a convex surface, as seen in a rotational direction of the impeller viewed from the back side of the impeller.

3. A centrifugal pump according to claim 1, wherein at least one of the protrusions comprises a concave surface, as seen in a rotational direction of the impeller viewed from the back side of the impeller.

4. A centrifugal pump according to claim 1, wherein at least one of the protrusions comprises a right angled surface, as seen in a rotational direction of the impeller viewed from the back side of the impeller.

5. A centrifugal pump according to claim 1, wherein at least one of the protrusions comprises a tilted surface, as seen in a rotational direction of the impeller viewed from the back side of the impeller.

6. A centrifugal pump according to claim 1, wherein the protrusions are arranged at an angular distance from each other, as seen from a centre of the impeller.

7. A centrifugal pump according to claim 1, wherein the protrusions are arranged in a spiral-shaped pattern on the impeller.

8. A centrifugal pump according to claim 1, wherein the aggregated radial extension of the protrusions equals the radius of the impeller within an interval of ±10%.

9. An impeller configured to be arranged in a centrifugal pump that also includes a back plate, the impeller the comprising:

a plurality of vanes for pumping a fluid through the centrifugal pump;

a scraper arranged on a back side of the impeller that is configured to face a surface of the back plate of the centrifugal pump, for allowing the scraper to scrape deposited material off from said surface;

the scraper comprising multiple protrusions on the back side of the impeller, the multiple protrusions being arranged at various radial distances from a centre of the impeller, and wherein an aggregated radial extension of all of the multiple protrusions equals a radius of the impeller within an interval of ±25%, the aggregated radial extension of all of the protrusions being a sum of the extension of the protrusions in the radial direction.

10. An impeller according to claim 9, wherein at least one of the multiple protrusions comprises, as seen in a rotational direction of the impeller, any of a convex surface, a concave surface, a right angled surface and a tilted surface.

11. An impeller according to claim 9, wherein at least two of the multiple protrusions are arranged at an angular distance from each other, as seen from a centre of the impeller.

12. An impeller according to claim 9, wherein the multiple protrusions are arranged in a spiral-shaped pattern on the impeller.

13. An impeller according to claim 9, further comprising a connector extending from the impeller and configured to extend through an opening in the surface of the centrifugal pump.

14. An impeller according to claim 9, wherein the aggregated radial extension of the protrusions equals the radius of the impeller is within an interval of ±10%.

15. A centrifugal pump for pumping a fluid, the centrifugal pump comprising:

a casing in which an impeller is arranged, the impeller possessing a back side facing a back plate of the centrifugal pump, wherein a gap is formed between the back side of the impeller and the back plate;

a connector extending from a centre of the impeller and through the back plate of the centrifugal pump to connect the impeller to a drive mechanism to rotate the impeller;

the impeller comprising a central portion and a plurality of vanes to pump the fluid, the central portion of the impeller surrounding the centre of the impeller and the plurality of vanes projecting away from the central portion so that a space exists between peripheral edges of circumferentially adjacent vanes;

the back side of the impeller comprising a segmented scraper for scraping from the back plate material that has deposited from the fluid, the segmented scraper comprising multiple protrusions located on the back side of each of the vanes and on the back side of the central portion, the protrusions on the back side of the central portion being circumferentially spaced apart from one another;

at least some of the multiple protrusions being arranged at different radial distances from the centre of the impeller;

each of the multiple protrusions facing the back plate; and an aggregated radial extension of all of the protrusions equals a radius of the impeller within an interval of up to ±25%, the aggregated radial extension of the protrusions being a sum of the extension of all of the protrusions in the radial direction.

16. A centrifugal pump according to claim 15, wherein the plurality protrusions are arranged in a spiral-shaped pattern on the impeller.

17. A centrifugal pump according to claim 15, wherein the aggregated radial extension of the protrusions equals the radius of the impeller within an interval of ±10%.

* * * * *